US006810221B1

(12) United States Patent
Meyer et al.

(10) Patent No.: US 6,810,221 B1
(45) Date of Patent: Oct. 26, 2004

(54) APPARATUS AND METHOD FOR DISCHARGING AN ELECTROPHOTOGRAPHY COMPONENT

(75) Inventors: Brent Meyer, Boise, ID (US); Darius Boockholdt, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/422,204

(22) Filed: Apr. 24, 2003

(51) Int. Cl.[7] ..... G03G 15/00; G03G 15/02

(52) U.S. Cl. ..... 399/90; 399/176

(58) Field of Search ..... 399/50, 90, 115, 399/119, 121, 123, 227, 279, 286, 313, 174–176

(56) References Cited

U.S. PATENT DOCUMENTS

| | | | |
|---|---|---|---|
| 5,095,335 A | | 3/1992 | Watanabe et al. |
| 5,227,851 A | | 7/1993 | Yoshida et al. |
| 5,430,527 A | | 7/1995 | Maruyama et al. |
| 5,465,136 A | | 11/1995 | Watanabe |
| 5,666,608 A | | 9/1997 | Christensen |
| 5,978,616 A | | 11/1999 | Shin |
| 6,118,962 A | | 9/2000 | Casper et al. |
| 6,173,143 B1 | | 1/2001 | Hirota et al. |
| 6,233,422 B1 | * | 5/2001 | Abe et al. |
| 6,381,432 B1 | | 4/2002 | Hattori |
| 6,385,416 B1 | | 5/2002 | Horikawa et al. |
| 6,385,420 B1 | | 5/2002 | Morioka |
| 6,665,507 B1 | * | 12/2003 | Hooper et al. ..... 399/115 |

FOREIGN PATENT DOCUMENTS

JP 2002258581 A * 9/2002 ..... G03G/15/02

* cited by examiner

*Primary Examiner*—Arthur T. Grimley
*Assistant Examiner*—Ryan Gleitz
(74) *Attorney, Agent, or Firm*—Robert D. Wasson

(57) ABSTRACT

A conductive isolation member for electrophotography components is disclosed. In one embodiment, a cartridge for use in an image forming device includes a photosensitive drum, an electrophotography component, and a conductive isolation member electrically connected to the electrophotography component to permit discharge of static charge on the electrophotography component upon removal of the conductive isolation member.

20 Claims, 6 Drawing Sheets

APPARATUS AND METHOD FOR DISCHARGING AN ELECTROPHOTOGRAPHY COMPONENT

BACKGROUND

Current image-forming devices exist in a variety of different configurations. Examples of current image-forming devices include printers, copiers, multifunction products, and the like.

Conventional image-forming devices may form an image by applying toner to a medium such as paper and fuse the toner onto the paper. One known toner generally comprises a mix of polymers, magnetite, charging agents, flow agents, and pigments or dyes. The toner is typically supplied from a removable cartridge.

Some conventional image-forming devices generally create an image upon a medium such as paper by initially creating a uniform negative charge on the surface of a photosensitive drum. This photosensitive drum is often referred to as an organic photoconductor (OPC) drum. A latent image is then formed on the photosensitive drum by modulating laser beams or other light on the photosensitive drum. The latent image on the photosensitive drum is changed to a visual image by the toner that is itself charged and is applied by a developer roller. The visual image created by the toner on the photosensitive drum is transferred to the medium by a transfer charging roller. Thereafter, the transferred toner is fused with heat and pressure to form a permanent image on the medium.

Electrophotography components that contact the photosensitive drum can develop a static electrical charge. An example of an electrophotography component that may contact the photosensitive drum is a primary charge roller. This static electrical charge may cause plus charge memory, also referred to as rubbed memory, on the photosensitive drum when the electrophotography component having the static electrical charge contacts the photosensitive drum. Additional background details are described in U.S. Pat. No. 5,666,608, the disclosure of which is hereby incorporated by reference.

DETAILED DESCRIPTION

Figure 1:
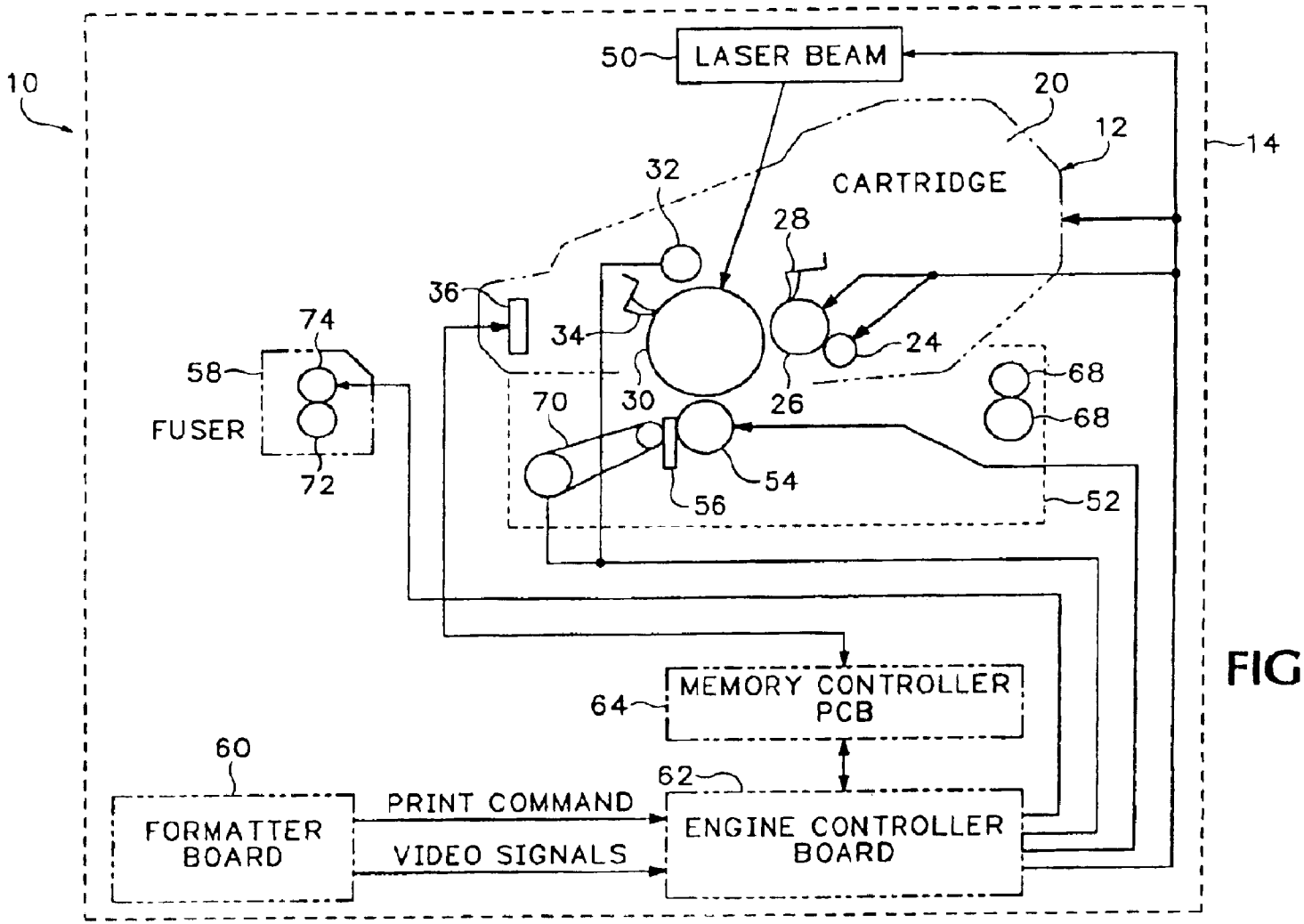
FIG. 1 is a schematic illustration of an image forming device including a main assembly and a cartridge.

FIG. 1 schematically illustrates an example embodiment of an image forming system or device 10, which generally includes a cartridge 12 and a main assembly 14. The cartridge 12 is configured to be releasably coupled to main assembly 14 in a conventional manner. The cartridge 12 generally supplies toner for forming images. In the particular embodiment illustrated, the cartridge 12 additionally includes components for transferring toner to a print media, such as paper 88 (e.g., FIG. 2). The cartridge 12 generally includes supply hopper 20, supply roller 24, developer roller 26, blade 28, photosensitive drum 30, charging roller 32, cleaner blade 34, and memory 36.

Supply hopper 20, which may comprise one or more chambers, supplies toner (e.g., FIG. 2) to developer roller 26. For purposes of this disclosure, the term "toner" means any pigment or dye containing material used for forming an image on a medium, such as polymer, paper and the like. Toner is typically electrically chargeable. In one embodiment, the toner includes a mix of dye or pigment impregnated plastic, magnitite, various conventionally known electrical charging agents that enhance the ability of the toner to take on an electrical charge and flow agents. In alternative embodiments, the toner utilized by device 10 may comprise other conventionally known or future developed toners that are capable of being electrically charged to a degree sufficient so as to enable the toner to be used by device 10 to form an image upon a print medium. Although the cartridge 12 is illustrated as including such components as supply roller 24, developer roller 26, blade 28, photosensitive drum 30, charging roller 32 and cleaner blade 34, these components may be omitted in alternative embodiments. For example, in some applications, main assembly 14 may include photosensitive drum 30 in lieu of photosensitive drum 30 being provided as part of cartridge 12. Also, as another example, in some applications, the supply roller 24 may be omitted.

Supply roller 24, developer roller 26 and blade 28 are each conventionally known. Supply roller 24 supplies toner to developer roller 26, which, in turn, supplies toner to photosensitive drum 30. Blade 28 removes excess toner from developer roller 26. In the particular embodiment illustrated, each of rollers 24 and 26 and blade 28 are electrically charged so as to apply charge to the toner. With such charging, the toner attains a negative charge. The charged particles upon developer roller 26 are then transferred to an electrically charged photosensitive drum 30.

Although rollers 24 and 26 and blade 28 are illustrated and described as being electrically charged so as to apply charge to the toner, less than all of these components, as well as additional or alternative components, may alternatively be used to apply electrical charge to the toner.

Photosensitive drum 30, charging roller 32 and blade 34 are each conventionally known. Charging roller 32 applies a generally uniform negative charge on the surface of drum 30 which is generally rotatably driven in a clockwise direction as seen in FIG. 1. Prior to receiving toner from developer roller 26, light is projected upon the surface of the drum to discharge the negative potential along the surface of the photosensitive drum where the light strikes the surface. As a result, a latent electrostatic image is created on drum 30. As will be described in greater detail hereafter, this light may be in the form of a laser beam 81 (e.g., FIG. 2).

Once the latent electrostatic image is formed on drum 30, the charged particles from developer roller 26 are transferred to drum 30 in the form of the visible image. This visible image is then transferred to a medium such as paper. Excess or residue toner on the surface of drum 30 is removed by blade 34.

Main assembly 14 is generally configured to cooperate with cartridge 12 so as to form an image upon a medium such as paper. Main assembly 14 generally includes image writing system 50, media transport 52, transfer charging roller 54, static charge eliminator 56, fuser 58, and a controller generally including formatter board 60, engine controller board 62, and memory controller 64. Image writer 50 is generally configured to apply light or other waves to photosensitive drum 30, such as in the form of a laser, to write a latent electrostatic image upon the surface of drum 30.

Media transport 52 is conventionally known and generally comprises that portion of main assembly 14 which is configured to supply and transport a medium, such as paper, upon which an image is to be formed. In the particular embodiment illustrated, media transport 52 includes various rollers 68 and a belt 70 configured to transport media from a paper supply (not shown) between photosensitive drum 30 and transfer charging roller 54 and further to fuser 58. Various other conventionally known or future developed media transfer mechanisms may be employed in lieu of the one schematically shown.

Transfer charging roller 54 and static charge eliminator 56 are each conventionally known. Transfer charging roller 54 facilitates the transfer of toner from drum 30 to the media in a conventionally known manner. Thereafter, static charge upon the media is removed by static charge eliminator 56 in a conventionally known manner. Once the toner has been transferred to the media, media transport 52 transfers the media to fuser 58.

Fuser 58 is configured to fuse the toner to the media to form a permanent image on the media. In the particular embodiment illustrated, fuser 58 fuses the media with heat and pressure. Fuser 58, which is conventionally known, generally includes a pressure roller 72 and a film unit 74. After the image has been permanently fused to the media by fuser 58, the media is expelled by main assembly 14.

The controller including formatter board 60, engine controller board 62 and memory controller 64 generally controls the operation of the remainder of cartridge 12 and main assembly 14. In particular, formatter board 60 sends a print signal and a video signal to the engine controller board 62. In response, the engine controller board 62 drives a main motor (not shown) to rotate photosensitive drum 30, charging roller 32, supply roller 24, developing roller 26, various belts and rollers of media transport 52, transfer charging roller and the pressure roller, amongst others. In response to signals from the engine controller board based upon the video signals, image writing system 50 modulates laser beams to create a latent image on the photosensitive drum.

Memory controller 64 generally comprises a control circuit configured to write data to memory 36 and read data from memory 36 of cartridge 12. Memory controller 64 records such data on memory 36 such as the number of copies or amount of media printed upon using toner from cartridge 12, job length, media size, mode, coverage, fuser and other historical data regarding the image formation using cartridge 12. Controller 64 further reads such recorded information from memory 36 and based on such information, cooperates with engine controller board 62 to generate control signals.

In the embodiment shown in FIG. 1, certain electrophotography components, such as the charging roller 32, the developer roller 26, and blade 34 may contact, or come into close proximity with, the photosensitive drum 30. Before first operation of the cartridge 12, such as during shipping, static charge may develop on these electrophotography components. If this static charge is conducted to the photosensitive drum 30, the photosensitive drum 30 may develop a region on the outer surface thereof that has a different charge than other regions of the outer surface of the photosensitive drum 30. This charge differential on the outer surface of the photosensitive drum 30 may adversely affect print quality, particularly if the charge differential is located in a print region of the photosensitive drum 30.

A conductive isolation member 73 (e.g., FIG. 2) is removably positioned in electrical contact with an outer surface of such electrophotography components. Prior to the first use of the cartridge 12, a user removes the conductive isolation member 73 from the cartridge 12 by manually grasping the cartridge, such as with the user's hand, and pulling, or otherwise removing, the conductive isolation member 73 from the cartridge 12. When the user grasps the conductive isolation member 73, the electrophotography component, the conductive isolation member 73, and the user form an electrical circuit for discharging static charge on the electrophotography component. Thus, the conductive isolation member 73 drains static charge that may have formed on the electrophotography component, such as the charging roller 32, during removal of the conductive isolation member 73. The static charge dissipates through the user's hand upon removal of the conductive isolation member 73, since the conductive isolation member 73 is electrically coupled to the electrophotography component when the user grasps the conductive isolation member 73.

Figure 2:
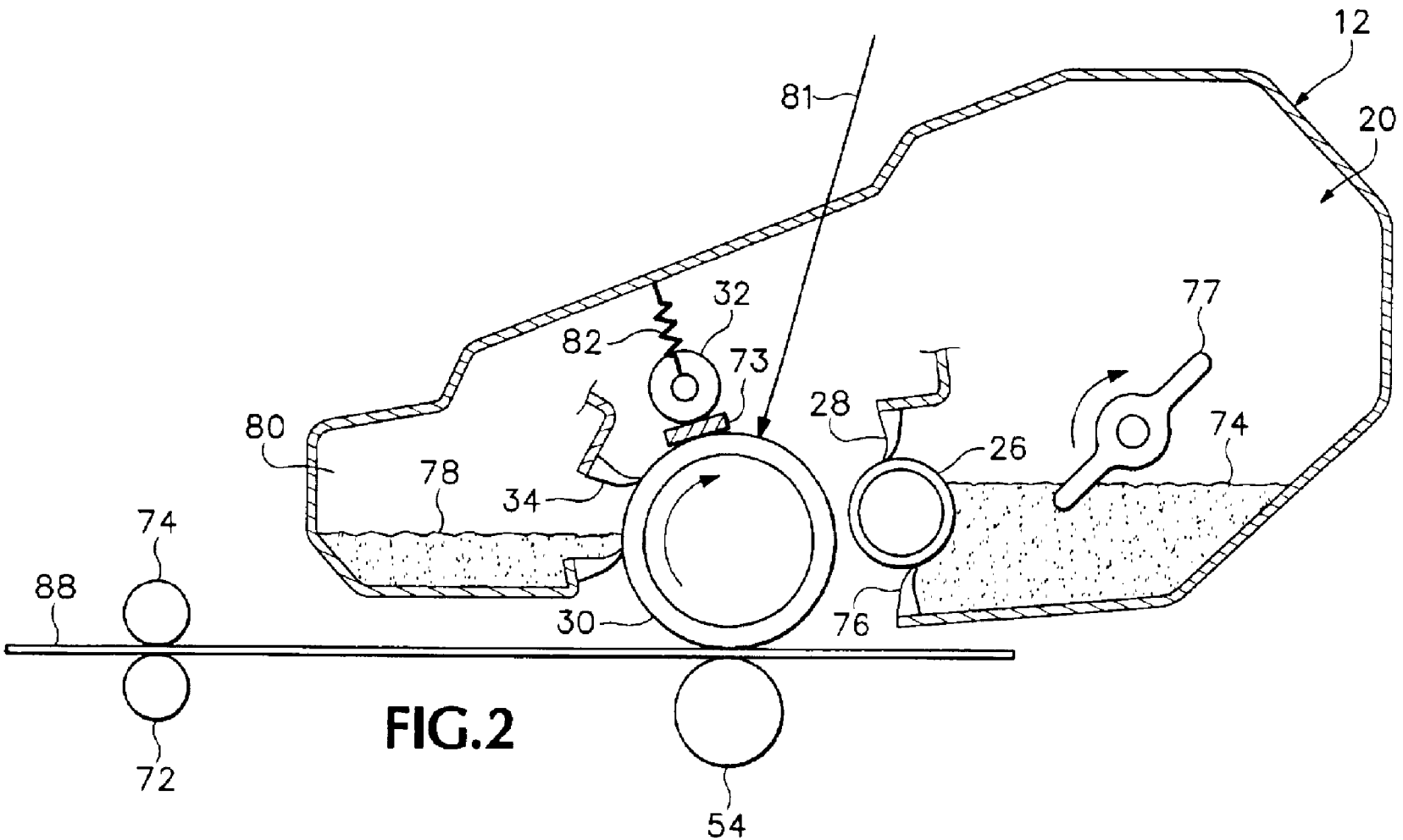
FIG. 2 is a sectional view schematically illustrating a cartridge having a conductive isolation member in accordance with an example embodiment of the present invention.

FIG. 2 illustrates an example embodiment of a cartridge 12. For ease of illustration, the exterior enclosure or housing of cartridge 12 is not shown. The exact configuration of the exterior housing or enclosure of cartridge 12 may vary depending upon the size and configuration of the various internal components of cartridge 12 as well as the interfacing relationship between cartridge 12 and the main assembly 14 (FIG. 1).

The cartridge 12 includes a supply hopper 20, which may have toner 74 disposed therein. Stirring blade 76 is also positioned within the supply hopper 20 and is operative to stir the toner 74. A developer sealing blade 76 helps maintain the toner 74 within the supply hopper 20 and substantially prevents toner 73 from passing from the supply hopper 20 between the developer sealing blade 76 and the development roller 26. The blade 34 wipes excess toner 78 from the photosensitive drum 30. Waste toner chamber stores the excess toner 78.

In the illustrated embodiment, the charging roller 32 may be biased toward the photosensitive drum 30, such as by a spring 82 or other suitable biasing member or mechanism. The conductive isolation member 73 is positioned in electrical contact with the charging roller 32. Thus, upon user manual removal of the conductive isolation member 73, static electric charge on the charging roller 32 is dissipated by conducting from the conductive isolation member 73, through the conductive isolation member 73 to the user. Hence, after removal of the conductive isolation member 73 from the cartridge 12, the charging roller 32 is substantially free from static electrical charge, thereby reducing or eliminating the potential for damage to the photosensitive drum 30 by static electrical charge on the charging roller 32.

As shown, the conductive isolation member 73 is formed of a suitable conductive material, such as metal. The shape of the conductive isolation member 73 may vary. For example, the conductive isolation member 73 may comprise, but is not limited to, an elongated sheet of conductive material, a conductive tape, a conductive pin.

Hence, pursuant to some embodiments, the conductive isolation member 73 is tightly disposed between the charging roller 32 and the photosensitive drum 30 by a compression fit so that the biasing force of the spring 82 maintains the conductive isolation member 73. Upon removal of the conductive isolation member 73 the spring 82 moves the charging roller 32 into contact or close proximity to the photosensitive drum 30 (see, e.g., FIG. 4). In some applications, the conductive isolation member 73 contacts the photosensitive drum 30 at a region outside of an imaging region thereof to further limit potential damage to the imaging region of the photosensitive drum 30.

In another embodiment, the conductive isolation member 73 is adhered to the charging roller 32 and may or may not be disposed between the charging roller 32 and the photosensitive drum 30 as shown in FIG. 2. The conductive isolation member 73, in this embodiment may have an adhesive, such as an electrically conductive adhesive, thereon to facilitate adhering the conductive isolation member 73 to an electrophotography component, such as the charging roller 32.

Figure 3:
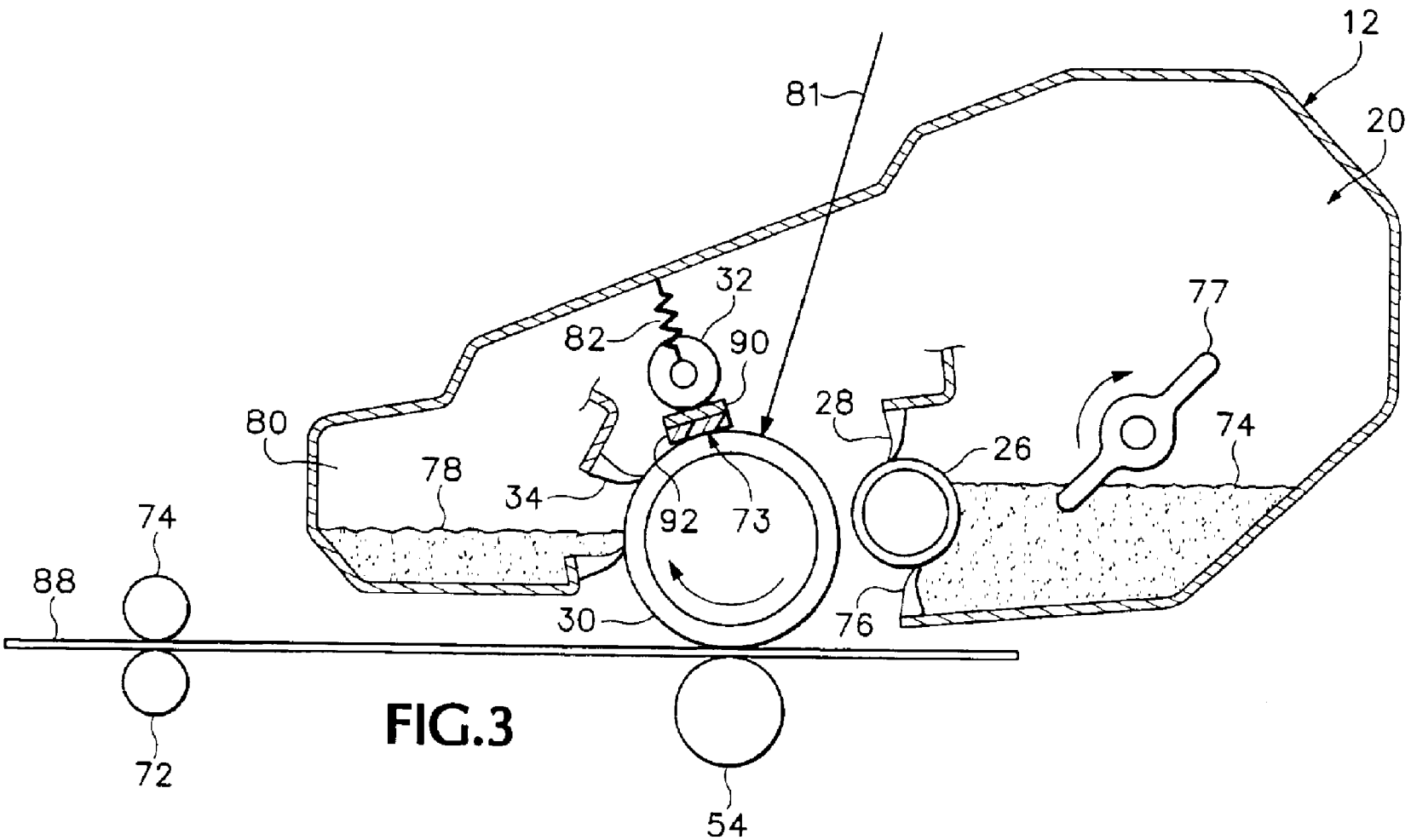
FIG. 3 is a sectional view schematically illustrating a cartridge having a conductive isolation member in accordance with another example embodiment of the present invention.

FIG. 3 illustrates another embodiment of the cartridge 12. This embodiment is identical to that described above with reference to FIG. 2, except as follows. In the embodiment of FIG. 3, the conductive isolation member 73 includes a conductive material 90 on a non-conductive material 92. As shown, the conductive material 90 is in electrical contact, or connection, with the charging roller 32 and the non-conductive material 92 contacts a surface of the photosensitive drum 30. In this configuration, static charge on an electrophotography component, such as the charging roller 32, may be discharged via the conductive material 90 while the non-conductive material 92 insulates the photosensitive drum 30 from the static charge.

Figure 4:
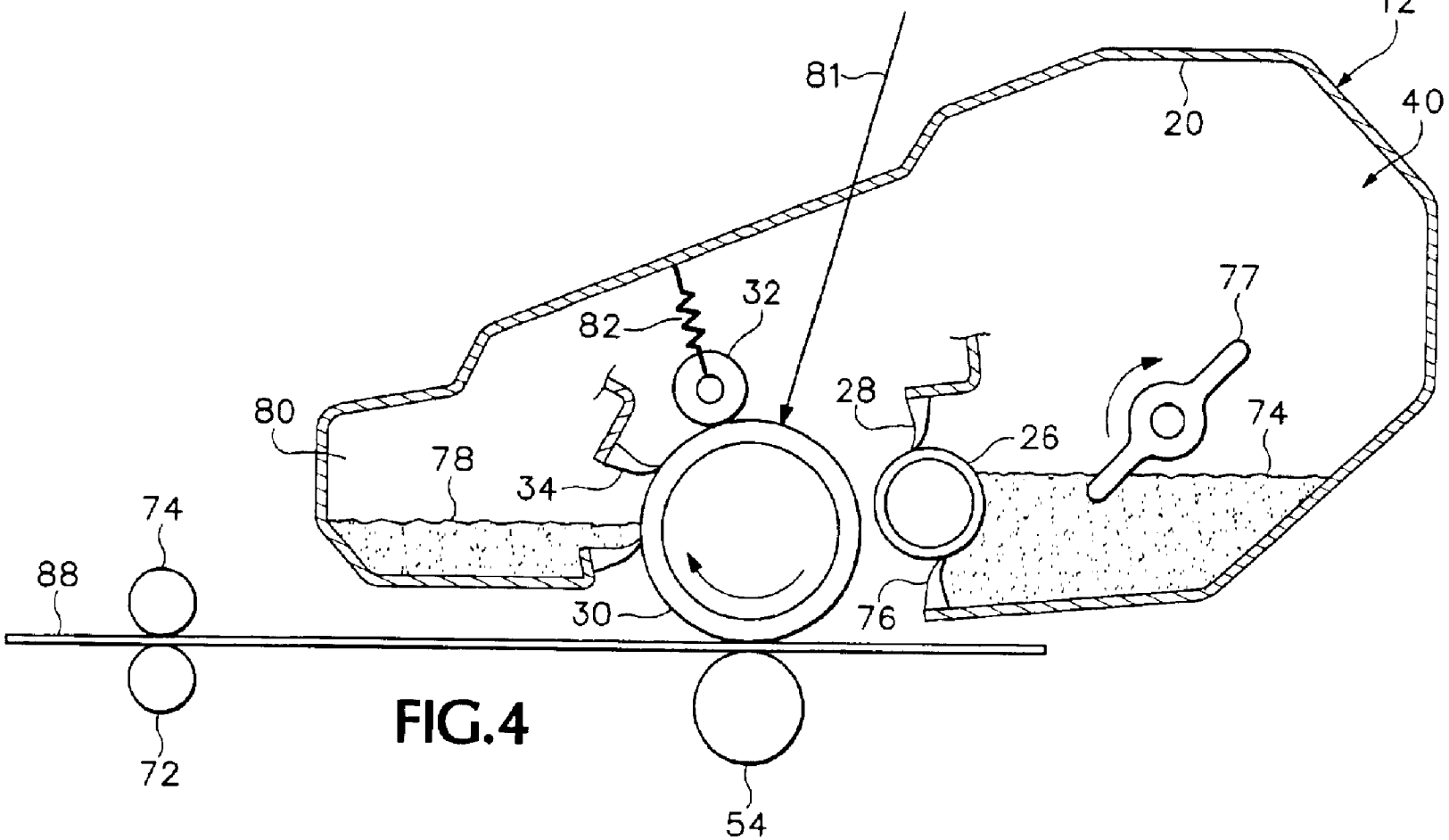
FIG. 4 is a sectional view schematically illustrating a cartridge having a conductive isolation member removed in accordance with another example embodiment of the present invention.

FIG. 4 illustrates the cartridge 12 with the conductive isolation member 73 removed. As shown, with the conductive isolation member 73 removed from between the charging roller 32 and the photosensitive drum 30, the biasing force of the spring 82 pushes the charging roller 32 into close proximity, or in contact with, the photosensitive drum 30.

Figure 5:
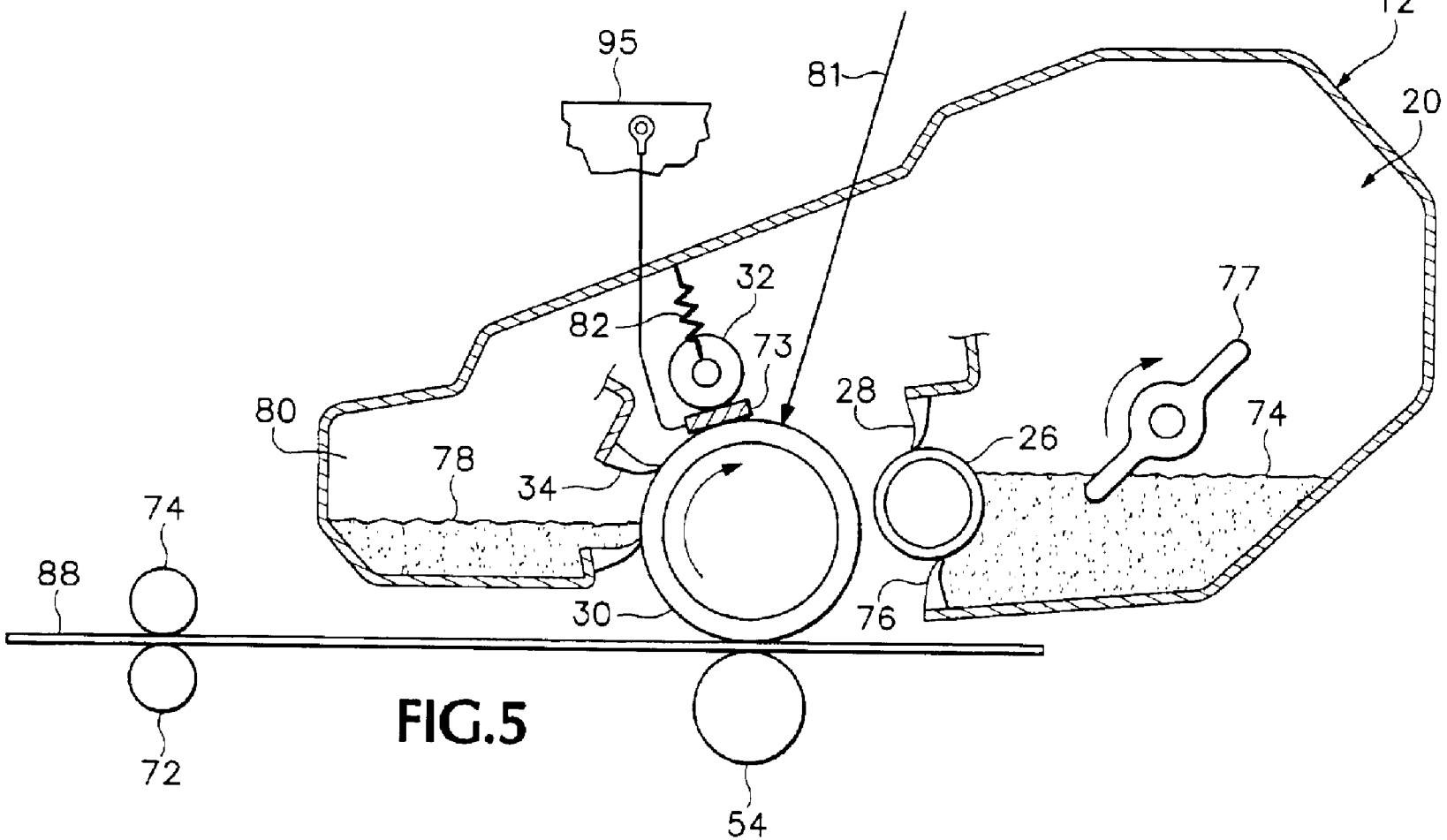
FIG. 5 is a sectional view schematically illustrating a cartridge having a conductive isolation member in accordance with another example embodiment of the present invention.

FIG. 5 illustrates another embodiment of the cartridge 12. This embodiment is identical to that described above with reference to FIG. 2, except as follows. Pursuant to this embodiment, the conductive isolation member 73 is electrically coupled to a grounding member 95, such as a metal chassis (not shown) of the main assembly 14. In this embodiment, static electric charge on the charging roller 32 is discharged through the conductive isolation member 73 and to the grounding member 95.

Figure 6:
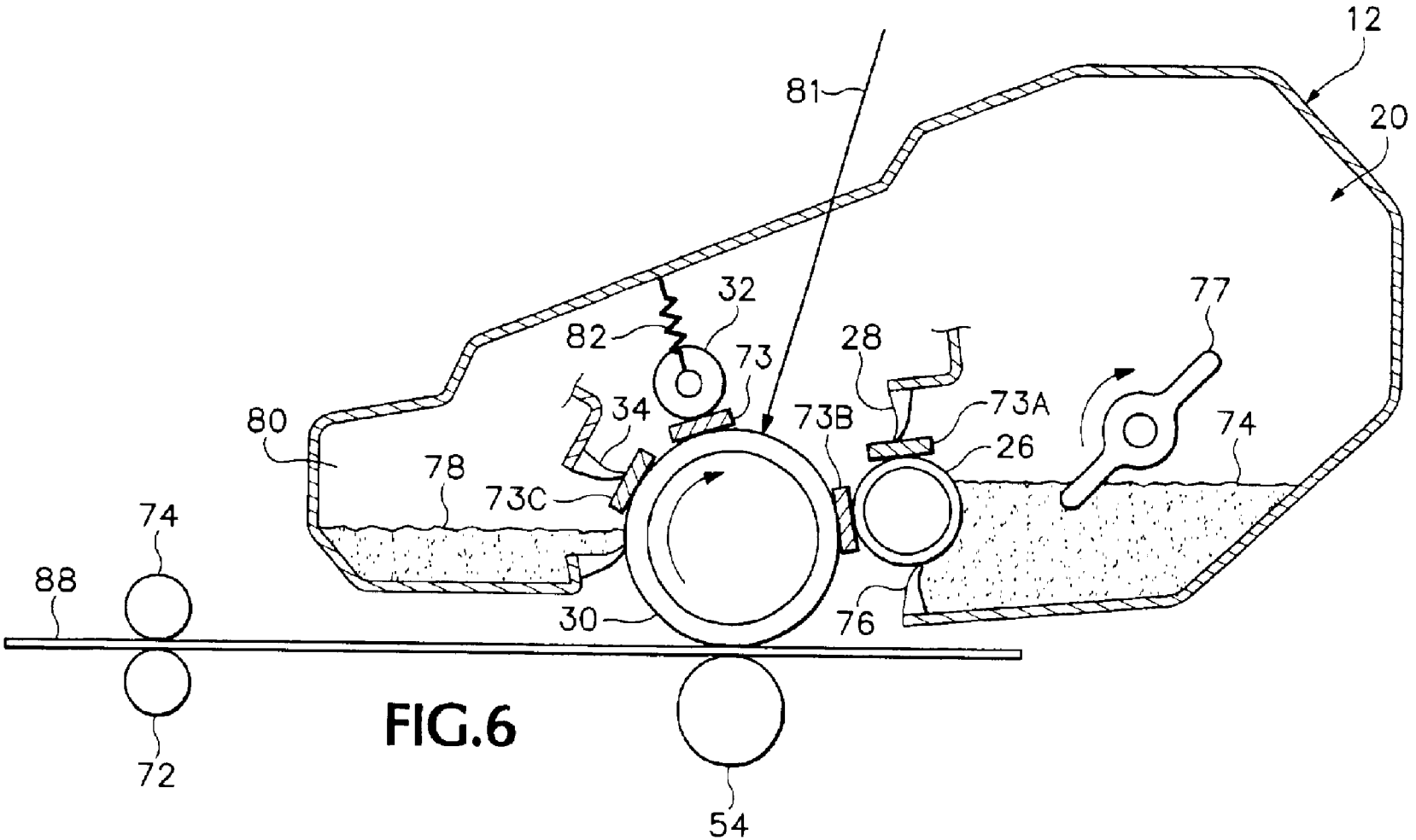
FIG. 6 is a sectional view schematically illustrating a cartridge having conductive isolation members in accordance with another example embodiment of the present invention.

FIG. 6 illustrates another embodiment of the cartridge 12. This embodiment is identical to that described above with reference to FIG. 2, except as follows. As shown in FIG. 6, multiple conductive isolation members may be electrically connected to multiple electrophotography components, respectively. In the example embodiment shown, conductive isolation members 73A, 73B are electrically connected to the developer roller 26. The conductive isolation member 73A is positioned between the blade 28 and the roller 26. The conductive isolation member 73B is positioned between the developer roller 26 and the photosensitive drum 30. A conductive isolation member 73C is shown as being electrically connected to the blade 34 and positioned between the blade 34 and the photosensitive drum 30. The conductive isolation members 73A, 73B, 73C may be electrically connected to respective electrophotography components by an adhesive, such as an electrically-conductive adhesive, by a compression fit or other suitable technique.

Hence, FIG. 6 illustrates a cartridge 12 having conductive isolation members 73, 73A, 73B, and 73C. In one embodiment, one or more of the conductive isolation members shown in FIG. 6 are configured identical to the conductive isolation member 73 shown in FIG. 3 and described above with reference to FIG. 3.

Accordingly, embodiments of the present invention permit static charge on an electrophotography component to be discharged through a conductive isolation member electrically connected thereto. In one embodiment, static charge conducts from the electrophotography component, through the conductive isolation member to a user upon removal of the conductive isolation member from the cartridge.

While the present invention has been particularly shown and described with reference to the foregoing embodiments, those skilled in the art will understand that variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A cartridge for use in an image forming device, the cartridge comprising:

a photosensitive drum;

an electrophotography component having an electrically conductive surface;

an electrically conductive isolation member removably disposed between the photosensitive drum and electrically connected to the electrically conductive surface of the electrophotography component for draining charge on the electrophotography component upon removal of the electrically conductive isolation member from the cartridge.

2. The cartridge according to claim 1, wherein the isolation member comprises a conductive material on a non-conductive material.

3. The cartridge according to claim 1, wherein the electrophotography component comprises a charge roller configured to apply a substantially uniform charge on a surface of the photosensitive drum.

4. The cartridge according to claim 1, wherein the conductive isolation member is disposed between the photosensitive drum and the electrophotography component by a compression fit.

5. The cartridge according to claim 1, wherein the conductive isolation member is adhered to the electrophotography component by an adhesive.

6. The cartridge according to claim 1, wherein the electrophotography component comprises a transfer roller configured to apply a charge to print media.

7. The cartridge according to claim 1, wherein the electrophotography component comprises a development roller configured to supply toner to the photosensitive drum.

8. The cartridge according to claim 1, wherein the electrophotography component comprises a cleaning blade configured remove toner from the photosensitive drum.

9. A laser printer device comprising the cartridge according to claim 1.

10. A method for draining charge from an electrophotography component, the method comprising:

interposing a conductive member between an electrophotography component and a photosensitive drum to maintain the electrophotography component and the photosensitive drum in spaced relation to each other;

manually grasping the conductive member to permit dissipation of charge formed on the electrophotography component through the conductive member.

11. The method according to claim 10, wherein the manually grasping comprises a human touching the conductive member such that an electrical circuit is formed between the electrophotography component and the human.

12. The method according to claim 10, wherein the conductive member comprises a conductive material on a non-conductive material, the conductive material being in electrical contact with the electrophotography component and the non-conductive material being in contact with the photosensitive drum.

13. The method according to claim 10, wherein the electrophotography component comprises a charge roller configured to apply a substantially uniform charge on a surface of the photosensitive drum.

14. The method according to claim 10, wherein the conductive member is interposed between the photosensitive drum and the electrophotography component by a compression fit.

15. The method according to claim 10, wherein the electrophotography component comprises a transfer roller configured to apply a charge to print media.

16. The method according to claim 10, wherein the electrophotography component comprises a development roller configured to supply toner to the photosensitive drum.

17. The method according to claim 10, wherein the electrophotography component comprises a cleaning blade configured remove toner from the photosensitive drum.

18. A cartridge, comprising:

a photosensitive drum;

a charge roller configured to apply a substantially uniform charge on a surface of the photosensitive drum;

a conductive isolation member electrically connected to and detachably coupled to the charge roller for draining charge on the charge roller upon detachment of the conductive isolation member from the charge roller.

19. The cartridge of claim 18, wherein the conductive isolation member comprises a conductive tape having an adhesive thereon.

20. A cartridge, comprising:

a photosensitive drum;

a charge roller configured to apply a substantially uniform charge on a surface of the photosensitive drum;

conductive tape electrically connected to and adhered to the charge roller for draining charge on the charge roller upon detachment of a conductive charge roller.

* * * * *